US007562843B2

(12) United States Patent
Lipponen

(10) Patent No.: US 7,562,843 B2
(45) Date of Patent: Jul. 21, 2009

(54) METHOD OF LAUNCHING A CATAPULT, CATAPULT, AND LOCKING DEVICE

(75) Inventor: Pentti Lipponen, Kangasala (FI)

(73) Assignee: Robonic Ltd Oy, Tampere (FI)

( * ) Notice: Subject to any disclaimer, the term of this patent is extended or adjusted under 35 U.S.C. 154(b) by 229 days.

(21) Appl. No.: 10/578,016

(22) PCT Filed: Nov. 11, 2004

(86) PCT No.: PCT/FI2004/000669

§ 371 (c)(1),
(2), (4) Date: May 3, 2006

(87) PCT Pub. No.: WO2005/047803

PCT Pub. Date: May 26, 2005

(65) Prior Publication Data

US 2007/0084965 A1 Apr. 19, 2007

(30) Foreign Application Priority Data

Nov. 12, 2003 (FI) ..... 20031644

(51) Int. Cl.
*B64F 1/06* (2006.01)

(52) U.S. Cl. ..... 244/63; 124/56

(58) Field of Classification Search ..... 244/63, 244/171.5, 171.3, 171.4; 124/56
See application file for complete search history.

(56) References Cited

U.S. PATENT DOCUMENTS 2,727,291 A * 12/1955 Hamblin ..... 24/601.6
4,079,901 A * 3/1978 Mayhew et al. ..... 244/63
4,101,098 A 7/1978 Hickle
4,101,099 A 7/1978 Hickle
5,052,973 A 10/1991 Rudell et al.

FOREIGN PATENT DOCUMENTS

| | | |
|---|---|---|
| DE | 38 12319 | 10/1989 |
| FR | 2 726 533 | 5/1996 |
| FR | 2 780 381 | 12/1999 |
| GB | 150411 | 8/1920 |
| GB | 2 293 146 | 3/1996 |

OTHER PUBLICATIONS

Airforce-technology.com, The website for the defence industries—air force "Hydromechanical engineering-Hydraulic systems, UAV ground support equipment and advanced test equipment" and "HEC have wide experience in the design and manufacture of bridge hydraulic systems for military vehicles." (2005) retrieved from http://www.airforce-technology.com/contractors/uav/hydromechanical.
English abstract of FR 2 780 381 dated Dec. 31, 1999.
English abstract FR 2 726 533 dated May 10, 1996.

* cited by examiner

*Primary Examiner*—Michael R Mansen
*Assistant Examiner*—Michael Kreiner
(74) *Attorney, Agent, or Firm*—Ladas & Parry LLP

(57) ABSTRACT

A method of launching a catapult, a catapult and a locking device for a catapult. The catapult comprises a carriage (4) for fastening an aircraft (5). The carriage (4) can be provided with a high acceleration by directing a launching force ($F_1$) generated by a launching device thereto. The carriage (4) can be held at a launching position (6) by means of the locking device (9). The catapult further comprises a takeoff damper (34) that generates a damping force ($F_2$) having a direction opposite relative to the launching force. Accordingly, the takeoff damper (34) restricts the acceleration of the carriage (4) at the initial launching moments.

7 Claims, 4 Drawing Sheets

METHOD OF LAUNCHING A CATAPULT, CATAPULT, AND LOCKING DEVICE

BACKGROUND OF THE INVENTION

The invention relates to a method of launching a catapult, the method comprising: generating a launching force by means of a launching device; keeping a carriage immovable by means of a locking device at a launching position of the catapult; directing the launching force to the carriage, which is movable from the launching position to a releasing position guided by a body of the catapult; releasing the locking device at a launching moment, whereby the carriage moves towards the releasing position at an accelerating speed by the action of the launching force; and sending off an aircraft arranged in the carriage to the air at the releasing position.

The invention further relates to a catapult for launching an unmanned aircraft and comprising: an elongated body, a launching position being provided on a portion of a first end thereof, and a releasing position being provided on a portion of a second end thereof; a carriage movable from the launching position to the releasing position and back, and the carriage comprising fastening members for supporting the aircraft; a launching device configured to generate a launching force for accelerating the carriage in a launching direction from the launching position to the releasing position; and at least one locking device for keeping the carriage at the launching position and for releasing it at a launching moment.

The invention still further relates to a locking device for a catapult, comprising: at least one locking piece configured to pivot around a joint towards a launching direction and towards a returning direction of the catapult; a connecting member provided in the locking piece, and to which connecting member a carriage comprised by the catapult is connectible before a launch and from where it is released after the launch.

A catapult can be used for launching a light unmanned air-craft, such as a drone, a surveillance plane or a missile to the air. The catapult typically comprises a carriage to which the aircraft is fastened and which carriage is catapulted at a high speed in such a manner that the aircraft obtains a controlled starting speed and direction for takeoff. The carriage can be moved for instance by means of a pneumatic or hydraulic cylinder, which is connected to act on the carriage by means of a wire or the like. Before being launched, the carriage can be kept in place by means of a locking device. At the same time, a maximum force is directed to the carriage. After the launch, the locking device releases the carriage, i.e. the force keeping the carriage in place is suddenly suppressed. Measurements have shown that the acceleration of the carriage is not even and controlled, but that immediately after the launch, the carriage is subjected to an acceleration peak or several peaks, which may even be followed by oscillation of acceleration. Acceleration peaks may exceed the maximum allowed acceleration value of the aircraft to be launched and may damage it.

BRIEF DESCRIPTION OF THE INVENTION

The object of the present invention is to achieve a new and improved method of launching a catapult, a locking device for a catapult, and a catapult.

The method of the invention is characterized by directing a damping force to the carriage at the launching moment, the direction of the force being opposite relative to the launching force, and the damping force resisting the movement of the carriage towards the releasing position; by dimensioning the magnitude of the damping force to maximum at the launching moment, and by reducing the damping force from maximum to minimum after the launch on a predetermined examination period.

The catapult of the invention is characterized in that the catapult comprises at least one takeoff damper configured to generate a damping force whose direction is opposite relative to the launching force, and the damping force is arranged to restrict the acceleration of the carriage at the launching moment, and that the damping force is at its maximum at the launching moment and that the damping force is arranged to decrease to zero after the carriage has moved a damping distance of a predetermined magnitude in the launching direction.

The locking device of the invention is characterized in that the locking device comprises at least one takeoff damper; that the takeoff damper is configured to generate a damping force; and that the takeoff damper is connected to the locking piece and configured to resist the turning of the locking piece towards the launching direction.

The essential idea of the invention is that the catapult comprises at least one takeoff damper configured to dampen the acceleration of the carriage and the aircraft fastened thereto at the launching moment and immediately thereafter. The damping force achieved with the takeoff damper is arranged to decrease after the launching moment.

An advantage of the invention is that it avoids the creation of acceleration peaks exceeding the allowed acceleration limit, thereby ensuring that during the launch, the aircraft is not subjected to excessive accelerations that could damage it. Furthermore, due to the damping, the acceleration stage may also otherwise be more controlled than without the takeoff damping.

The essential idea of an embodiment of the invention is to reduce the damping force from maximum to zero on a predetermined damping distance.

The essential idea of an embodiment of the invention is to reduce the damping force substantially linearly.

The essential idea of an embodiment of the invention is that the locking device comprises a pivotally arranged locking piece comprising a connecting member for holding the carriage. In addition, at least one takeoff damper is integrated into the locking piece. The takeoff damper is pivoted relative to the locking piece in a manner allowing it to turn at the same time with the locking piece. The effect of the takeoff damper on the locking piece is arranged to decrease relative to the turning angle of the locking piece, since the effective distance between the pivot point of the locking piece and the fastening point of the takeoff damper decreases as the locking piece turns towards the launching direction. In this manner a structure, wherein the damping force decreases substantially linearly may be achieved by means of a relatively simple mechanical structure. In addition, such a construction is reliable and inexpensive. A further advantage is that no separate adjusters are required for adjusting the damping force.

The essential idea of an embodiment of the invention is to dimension the length of the damping distance to at least 150 mm. In this case, the length of the damping distance is such that it allows the yields and masses in the pulling member and structure of the catapult to be taken into consideration in the damping.

The essential idea of an embodiment of the invention is to adjust the maximum of the damping force on the basis of the launching force employed. This allows the damping to be dimensioned always individually and exactly for each launch and aircraft type.

BRIEF DESCRIPTION OF THE FIGURES

The invention will be described in more detail in the accompanying drawings, in which.

For the sake of clarity, the figures show the invention in a simplified manner. In the figures, similar parts are denoted by the same reference numerals.

DETAILED DESCRIPTION OF SOME EMBODIMENTS OF THE INVENTION

Figure 1:
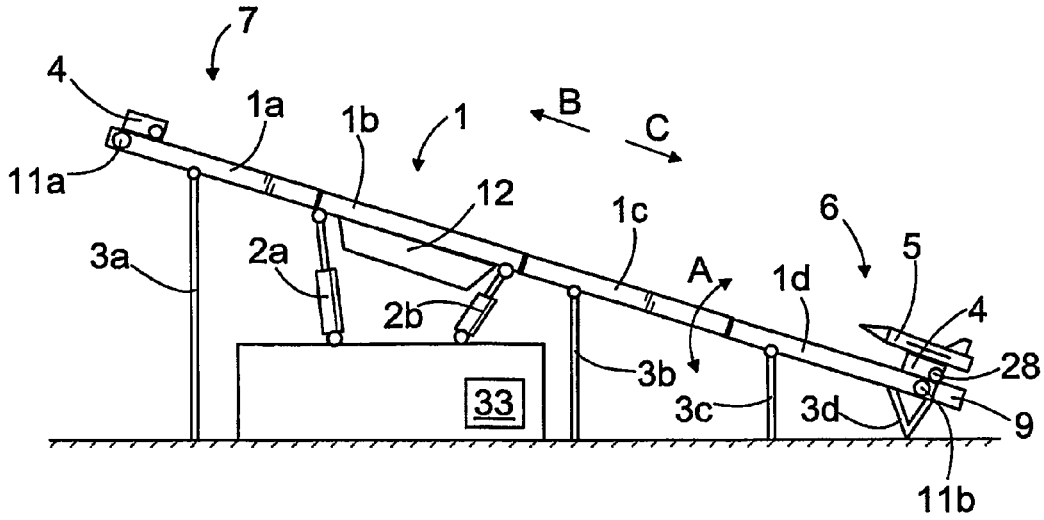
FIG. 1 is a schematic side view of a catapult provided with a locking device according to the invention, FIG. 2 schematically shows the principle of a launching apparatus, FIG. 3 schematically shows the acceleration of the carriage of a catapult as a function of time, FIG. 4 schematically shows a locking device and takeoff damper according to the invention, FIG. 5 schematically shows part of a locking device according to the invention, FIG. 6 schematically shows a second locking device according to the invention, and FIG. 7 schematically shows an arrangement for adjusting the damping force on the basis of the launching force.

FIG. 1 shows a catapult in a launching position. The catapult comprises an elongated body 1, which may be composed of several body portions 1*a* to 1*d*. The body 1 can be lifted and lowered for instance with hydraulic cylinders 2*a* and 2*b* so as to achieve the desired launching angle A. In addition, the body 1 can be supported with a suitable number of supports 3*a* to 3*d*. The catapult further comprises a carriage 4 having fastening members for fastening an aircraft 5. The carriage 4 may be supported on guiding surfaces or corresponding support surfaces provided in the body 1 by means of rollers, slide blocks or corresponding members. In the portion of a first end of the body 1 is provided a launching position 6 and in the portion of a second end is provided a releasing position 7. The carriage 4 is movable with high acceleration from the launching position 6 to the releasing position 7, where the aircraft 5 is released from the carriage and takes off. The aircraft 5 may be released from the carriage 4 at the second end of the body 1 or well before the carriage 4 reaches the second end of the body 1. After the launch, the carriage 4 can be returned to the launching position 6 for a new launch. The launching force required in the launch may be generated by means of a launching device, which FIG. 1 does not show in its entirety for the sake of clarity. Furthermore, the launching position 6 is provided with a locking device 9, which is able to hold the carriage 4 until the launching moment. In the locking position, the locking device 9 is able to receive the launching force directed to the carriage 4 and it may release the carriage 4 after the launch, whereby the carriage 4 accelerates at a high speed towards the releasing position 7. Accordingly, the catapult is used to provide the aircraft 5 with an as high takeoff speed as possible in a short distance. In principle, the aircraft 5 may be any relatively light unmanned aircraft, which may be provided with a propulsion device, such as an airscrew, jet engine or rocket engine. Furthermore, the aircraft 5 may comprise ailerons or other control members for controlling it with remote control or automatically by means of a control system in the aircraft 5. It is further mentioned that the catapult may be installed fixedly at the launching site or it may be a movable device, a device connected to a movable base, for example.

Figure 2:
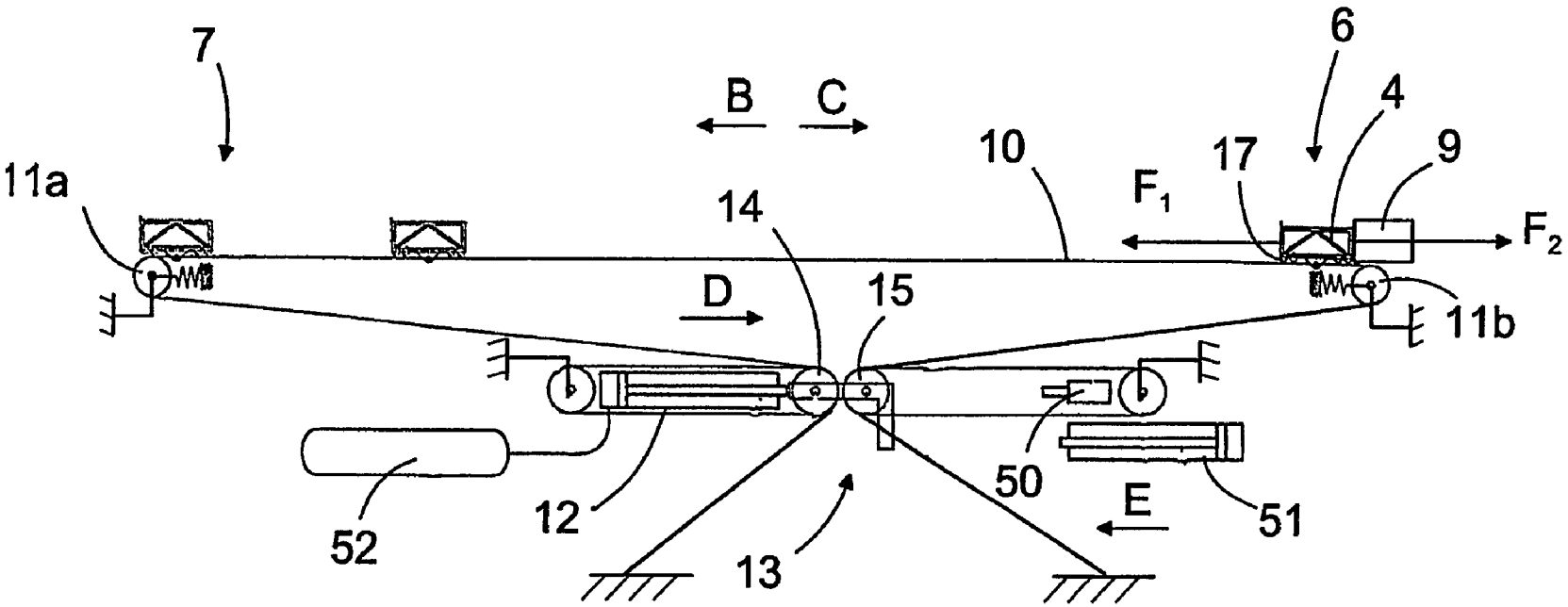

FIG. 2 shows in a strongly simplified manner a launching device with which the required launching force can be generated. For the sake of clarity, the aircraft and the catapult body are not shown at all. In the situation of FIG. 2, the carriage 4 is in the launching position 6, where it is kept immobile by means of a locking device 9. One or more pulling members 10, e.g. a wire arranged to pass around idler wheels 11*a* and 11*b*, are connected to the carriage 4. The pulling member 10 may also be some other pull-resistant flexible power transmission member, such as a cord, band or chain. The carriage 4 is movable from the launching position 6 to the releasing position 7 and vice versa by pulling the pulling member 10 either in the launching direction B or in the returning direction C. The force required by the launch can be generated in the pulling member 10 by means of a launching cylinder 12. The launching cylinder 12 may be a pneumatic cylinder or a hydraulic cylinder, which may be arranged to generate the launching force in the pulling member 10 by means of a tackle mechanism 13. In this case, the launching cylinder 12 may be arranged to move tackle pulleys 14 and 15 comprised by the tackle mechanism 13. For the launch, the carriage 4 is locked by means of the locking device 9 to the launching position 6, and the desired pulling force is generated in the pulling member 10 by moving the launching cylinder 12 in direction D. After the launch, the locking device 9 releases the carriage 4, whereby it initiates a strong acceleration. In accordance with the idea of the invention, the catapult comprises a takeoff damper 24, which is not shown in FIG. 3. The takeoff damper 24 is used to restrict the acceleration of the carriage 4 during the first moments of the launch. FIG. 2 further shows a stopping damper 50, which is able to stop the launching mechanism when the carriage 4 has reached the releasing position 7. The catapult may further comprise a return device 51, with which the carriage 4 can be moved back to the launching position 6 for a new launch.

Figure 3:
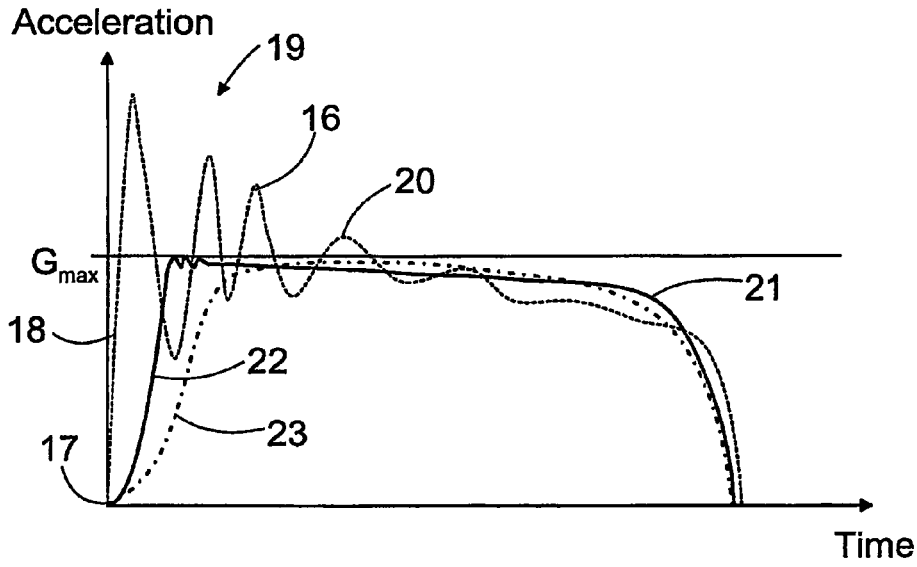

FIG. 3 shows, with a broken line, a curve 16 portraying the acceleration of a carriage of a prior art catapult as a function of time. The launch takes place at point 17, followed by a powerful acceleration. The powerful acceleration step 18 is followed by acceleration peaks 19, whose magnitude exceeds an upper limit $G_{max}$, the limit being defined by the magnitude of the accelerations that the aircraft 5 was dimensioned to tolerate. Since the acceleration peaks 19 clearly exceed the allowed acceleration, they may thus damage the aircraft. The acceleration peaks 19 are created by the yields of the body 1 of the catapult, the support structures and the pulling member 10, for example. Furthermore, the acceleration peaks 19 may be followed by oscillation of acceleration, which can be clearly detected as portions 20 of the curve 16. Oscillation of acceleration may cause problems in controlling the launch and unnecessary stress on the structures of the catapult.

FIG. 3 shows, with a solid line, an acceleration curve 21 of a catapult according to the invention as a function of time. In the invention, the acceleration of the carriage 4 is restricted with a takeoff damper 24 in the early moments of the launch, and therefore the launch does not take place in such an impact-like manner as in known solutions. Due to controlled acceleration, the acceleration curve 21 no longer shows significant acceleration peaks nor significant oscillation of acceleration following the powerful acceleration portion 22. Accordingly, the solution of the invention can be used to protect the aircraft from oversized accelerations directed thereto, and thus prevent damages. FIG. 3 further shows an acceleration curve 23, which is not linear in the portion of the powerful acceleration. Furthermore, the acceleration is affected by means of the takeoff damper 24 in such a manner that the acceleration curve 23 smoothly approaches the upper acceleration limit $G_{max}$. This enables avoidance of oscillations of acceleration.

Figure 4:
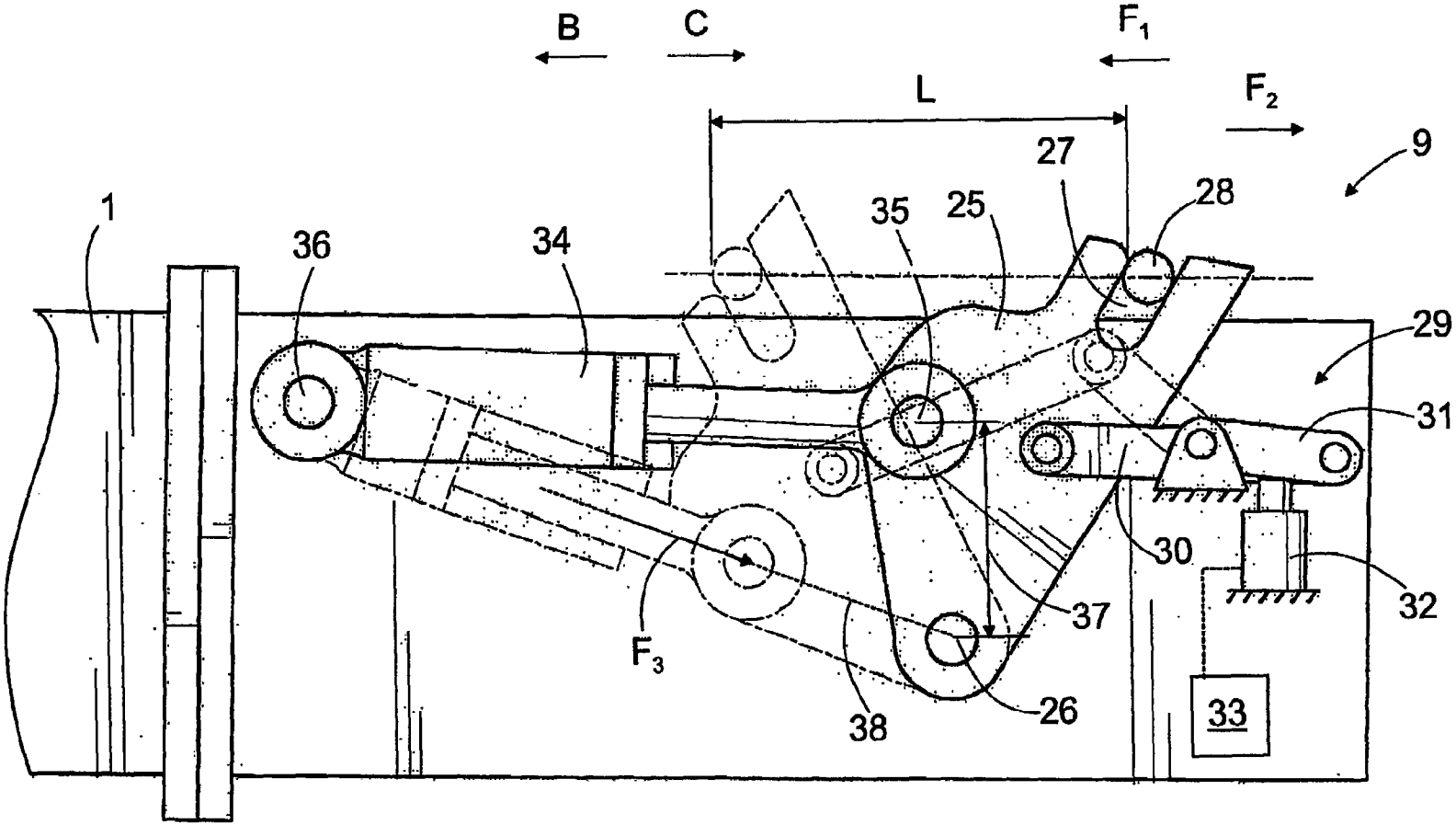

FIG. 4 shows a locking device 9, which may comprise one or more locking pieces 25, which may be configured to pivot around a joint 26 towards the launching direction B and, similarly, towards the returning direction C. The locking piece 25 may be a plate-like piece. The locking piece 25 may further comprise at least one connecting member 27, for instance a suitably shaped open groove, which may receive a locking pin 28 comprised by the carriage 4. When the locking piece 25 is in a back position, denoted by a solid line in the figure, it is capable of keeping the carriage 4 in place by means of its connecting member 27. When the locking piece 25 is allowed to turn around the joint 26 by the action of a launching force $F_1$ towards the launching direction B, the connecting member 27 turns to a position where the locking pin 28 is released from the connecting member 27, as a result of which the carriage 4 is released from the effect of the locking device 9. A lever mechanism 29, which may comprise two or more locking levers 30 and 31, pivoted together, may be connected to act on the locking piece 25. In the position denoted by a solid line in the figure, the locking levers 30 and 31 are arranged to overlap and substantially in the direction of the launching force at what is known as a blind angle, whereby they prevent the locking piece 25 from turning. The launch may take place in such a manner that one or more locking levers 30, 31 are lifted upwards by means of an actuator 32, allowing the locking levers 30, 31 to turn relative to each other due to their joints, and the locking can be released. The figure shows with broken lines the lever mechanism 29 after the launch. The actuator 32 may be for instance a pneumatic or hydraulic cylinder arranged to be controlled by a control system 33 of the catapult. Instead of the lever mechanism 29, other kinds of holding members can be naturally used. For safety reasons, the holding members are typically mechanical. FIG. 4 further shows that at least one takeoff damper 34, in this case a pressure medium cylinder, is arranged to act on the locking piece 25. The takeoff damper 34 is connected by means of a first joint 35 to the locking piece 25 and by means of a second joint 36 to the body 1 of the catapult, allowing the takeoff damper 34 to turn relative to the joints 35, 36 at the same time as the locking piece 25 turns relative to the joint 26. The takeoff damper 34 can be used to generate a damping force $F_2$, which is opposite relative to the launching force $F_1$. At the time of the launch, the magnitude of the damping force $F_2$ may be at its maximum, however, typically less than the launching force $F_1$, in order for the carriage 4 to be able to start acceleration in direction B. Because the locking pin 28 is still in the connecting member 27, the launching force $F_1$ starts to turn the locking piece 25 in direction B. This being so, the takeoff damper 34 also turns relative to the joints 35, 36, as a result of which the shortest possible effective distance between a straight line passing through the fulcrums 35 and 36 and the fulcrum 26, and the effective tension indicator 37 generated thereby, decreases relative to the turning angle of the locking piece 25. The turning results in the damping force $F_2$ starting to decrease immediately as the carriage 4 moves. In the solution of the figure, the damping force $F_2$ decreases at least approximately linearly relative to the distance travelled by the carriage 4. In FIG. 4, a dashed line shows a situation where the locking piece 25 and the takeoff damper 34 are turned to their extreme positions at a point where the carriage 4 is released from the effect of the locking device 9. In this position, the locking pin 28 is able to withdraw from the connecting member 27. The magnitude of the damping distance L between the launching position and the releasing position can be dimensioned to exceed 150 mm. This allows the yields and masses in the structures of the catapult to be dampened in a controlled manner and enables a substantial reduction in harmful acceleration peaks. The studies conducted show that, in practice, efficient dampening is difficult to achieve with distances shorter than this. However, the dampening distance L does not usually have to be dimensioned to exceed 500 mm. Furthermore, in a situation when the takeoff damper 34 is turned to the extreme position shown by the dashed line, i.e. what is known as the dead point, the line of a force $F_3$ generated by the takeoff damper 34 passes through the joint 26, i.e. the magnitude of the effective tension indicator 37 is then zero, i.e. the magnitude of the damping force $F_2$ is zero, too. The takeoff damper 34 may keep the locking piece 25 turned towards the launching direction B, whereby the locking pin 28 of the carriage 4 is again able to extend into the connecting member 27 during the return movement. Let it be mentioned that instead of a cylinder, the takeoff damper 34 may be some other actuator that achieves a corresponding linear movement.

Figure 5:
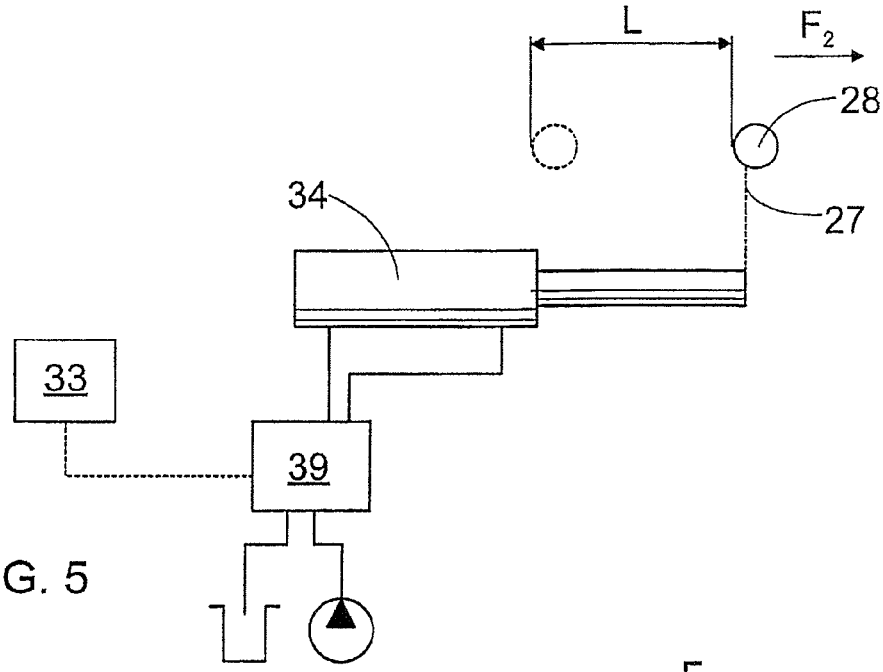

FIG. 5 shows a takeoff damper 34, the damping force $F_2$ generated by which can be adjusted by means of one or more adjusting components 39. When a pneumatic or hydraulic takeoff damper 34, such as a cylinder, is used, the adjusting component may be a valve, for example. The adjusting component 34 can be used to adjust the damping force $F_2$ versatilely in accordance with a preset adjustment strategy. The valve may be electrically controlled, whereby the control system 33 may be arranged to control it. Accordingly, the damping force $F_2$ can be controlled to decrease linearly, stepwise or in accordance with another curve, for instance the curve 23 shown in FIG. 3. Consequently, the rotationally pivoted locking piece 25 is not necessarily required at all in this solution. Furthermore, since the takeoff damper 34 does not have to be arranged rotationally, the structure can be implemented in a mechanically simpler manner. In addition, the structure of the locking device 9 can be made lower when it does not comprise rotating parts.

Figure 6:
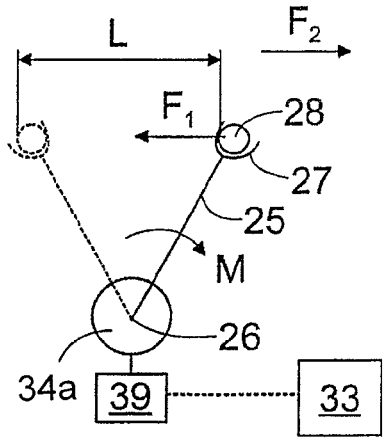

FIG. 6 illustrates a takeoff damper 34 arranged to create a torque M to achieve the damping force $F_2$. The takeoff damper 34 may be arranged in connection with the joint 26 of the turning locking piece 25. The takeoff damper 34 may be for instance an electromagnetic braking device controlled by the control system 33 of the catapult through one or more adjusting components 39. Furthermore, the takeoff damper 34 may be in the nature of an engine, the turning of whose shaft is resisted by means of pressure medium. The damping force $F_2$ generated by means of such takeoff dampers 34 can be controlled very versatilely. The takeoff damper 34 shown in FIG. 6 can be controlled for instance by the acceleration of the carriage being similar to the curve 23 shown in FIG. 3, for example.

Figure 7:
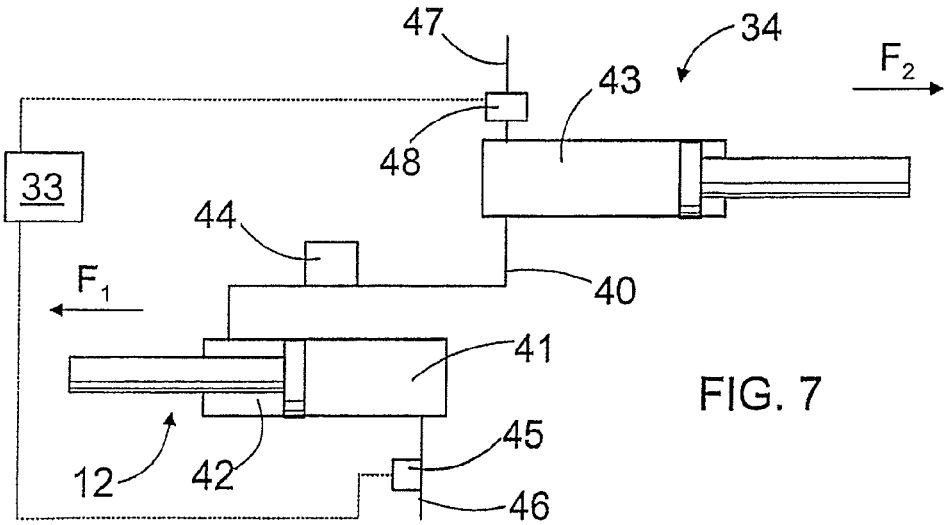

FIG. 7 shows an application where the magnitude of the damping force $F_2$ can be dimensioned on the basis of the launching force $F_1$. An alternative is to arrange an adjusting channel 40 between the pressure medium-driven launching cylinder 12 and the takeoff damper 34. When a higher acceleration is desired, a higher launching force $F_1$ is required. Accordingly, the pressure in a first chamber 41 of the launching cylinder 12 is increased. A piston then presses the pressure medium in a second chamber 42 of the launching cylinder 12 along the adjusting channel 40 to a first chamber 43 of the takeoff damper 34, causing the maximum value of the damping force $F_2$ to increase. One or more adjusting devices 44 for affecting the manner in which the increase in the launching force $F_1$ affects the damping force $F_2$ can also be arranged in the adjusting channel 40.

Furthermore, one or more sensors can be alternatively arranged in connection with the launching device in a manner enabling the measurement of the launching force $F_1$ either directly or indirectly. The sensor measuring the launching force $F_1$ may in some case be arranged in connection with the pulling member 10. The control system 33 of the catapult may adjust the maximum value of the damping force $F_2$ as desired on the basis of the measurement data obtained from the sensor. An alternative is to arrange a sensor 45 in a feeding channel 46 of the launching cylinder 12 and transfer the pressure data to the control system 33, which is then able to control a valve 48 or a corresponding adjusting component arranged in a feeding channel 47 of the takeoff damper 34 for adjusting the damping force $F_2$.

Let it still be mentioned that the damping force $F_2$ generated by means of the takeoff damper 34 can be reduced in some cases as a function of time. In this case, the control unit 33 of the catapult or the adjusting component 39 of the takeoff damper may be arranged to perform the adjustment. However, even in this case, the reduction in the damping force $F_2$ takes place in the portion of the damping distance L.

The drawings and the related description are only intended to illustrate the idea of the invention. The details of the invention may vary within the scope of the claims.

The invention claimed is:

1. A catapult for launching an unmanned aircraft, the catapult comprising:

an elongated body, a launching position being provided on a portion of a first end thereof, and a releasing position being provided on a portion of a second end thereof, a carriage movable from the launching position to the releasing position and back, and the carriage comprising fastening members for supporting the aircraft, a launching device configured to generate a launching force for accelerating the carriage in a launching direction from the launching position to the releasing position, at least one locking device for keeping the carriage at the launching position and for releasing the carriage at a launching moment, and at least one takeoff damper connected to the locking device by means of a joint and to generate a damping force having a direction that is opposite relative to the launching force, the damping force being arranged to restrict the acceleration of the carriage at the launching moment, wherein the damping force is at its maximum at the launching moment and the damping force is arranged to decrease to zero after the carriage has moved a damping distance of a predetermined magnitude in the launching direction.

2. A catapult as claimed in claim 1, wherein the locking device comprises at least one locking piece configured to pivot around a joint, the locking piece comprises at least one connecting member for holding the carriage, the connecting member being configured to release the carriage when the locking piece is turned towards the launching direction by a predetermined angle position, at least one takeoff damper is configured to resist the turning of the locking piece towards the launching direction and configured to generate the damping force, and the magnitude of the damping force is arranged to decrease relative to a turning angle of the locking piece.

3. A catapult as claimed in claim 1, wherein the locking device comprises at least one takeoff damper configured to generate the damping force, the launching device comprises at least one actuator configured to generate the launching force, and the catapult comprises means for identifying the magnitude of the launching force and means for adjusting the damping force on the basis of the launching force.

4. A locking device for a catapult, comprising:

at least one locking piece configured to pivot around a joint towards a launching direction and towards a returning direction of the catapult, a connecting member provided in the locking piece, to which connecting member a carriage comprised by the catapult is connectible before a launch and from where it is released after the launch, wherein the locking device comprises at least one takeoff damper, and the takeoff damper is configured to generate a damping force, wherein the takeoff damper is connected to the locking piece and configured to resist the pivoting of the locking piece towards the launching direction, and wherein the takeoff damper is a pressure medium cylinder, the takeoff damper is connected to the locking piece by means of a first joint, and further to a body of the catapult by means of a second joint, the shortest distance of a straight line passing through the first joint and the second joint is arranged to generate an effective distance, and the pivoting of the locking piece after the launching moment is arranged to reduce the effective distance, the damping force also being arranged to decrease substantially in the same ratio.

5. A catapult for launching an unmanned aircraft, the catapult comprising:

an elongated body, a launching position being provided on a portion of a first end thereof, and a releasing position being provided on a portion of a second end thereof, a carriage movable from the launching position to the releasing position and back, and the carriage comprising fastening members for supporting the aircraft, a launching device configured to generate a launching force for accelerating the carriage in a launching direction from the launching position to the releasing position, at least one locking device for keeping the carriage at the launching position and for releasing the locking device at a launching moment, and at least one takeoff damper connected to the locking device by means of a joint configured to generate a damping force having a direction that is opposite relative to the launching force, the damping force being arranged to restrict the acceleration of the carriage at the launching moment, wherein the damping force is at its maximum at the launching moment and the damping force is arranged to decrease to zero after the carriage has moved a damping distance of a predetermined magnitude in the launching direction, the locking device comprises at least one locking piece configured to pivot around a joint, the locking piece comprises at least one connecting member for holding the carriage, the connecting member being configured to release the carriage when the locking piece is turned towards the launching direction by a predetermined angle position, at least one takeoff damper is configured to resist the turning of the locking piece towards the launching direction and configured to generate the damping force, and the magnitude of the damping force is arranged to decrease relative to a turning angle of the locking piece.

6. A catapult for launching an unmanned aircraft, the catapult comprising:

an elongated body, a launching position being provided on a portion of a first end thereof, and a releasing position being provided on a portion of a second end thereof, a carriage movable from the launching position to the releasing position and back, and the carriage comprising fastening members for supporting the aircraft, a launching device configured to generate a launching force for accelerating the carriage in a launching direction from the launching position to the releasing position, at least one locking device for keeping the carriage at the launching position and for releasing the locking device at a launching moment, and at least one takeoff damper connected to the locking device by means of a joint configured to generate a damping force having a direction that is opposite relative to the launching force, the damping force being arranged to restrict the acceleration of the carriage at the launching moment, wherein the damping force is at its maximum at the launching moment and the damping force is arranged to decrease to zero after the carriage has moved a damping distance of a predetermined magnitude in the launching direction, the locking device comprises at least one takeoff damper configured to generate the damping force, the launching device comprises at least one actuator configured to generate the launching force, and the catapult comprises means for identifying the magnitude of the launching force and means for adjusting the damping force on the basis of the launching force.

7. A catapult for launching an unmanned aircraft, the catapult comprising:

an elongated body, a launching position being provided on a portion of a first end thereof, and a releasing position being provided on a portion of a second end thereof, a carriage movable from the launching position to the releasing position and back, and the carriage comprising fastening members for supporting the aircraft, a launching device configured to generate a launching force for accelerating the carriage in a launching direction from the launching position to the releasing position, at least one locking device for keeping the carriage at the launching position and for releasing the locking device at a launching moment, and at least one takeoff damper connected to the locking device by means of a joint configured to generate a damping force having a direction that is opposite relative to the launching force, the damping force being arranged to restrict the acceleration of the carriage at the launching moment, wherein the damping force is at its maximum at the launching moment and the damping force is arranged to decrease to zero after the carriage has moved a damping distance of a predetermined magnitude in the launching direction, and the locking device and the takeoff damper are arranged under an uppermost surface of the elongated body of the catapult along which surface the carriage is arranged to be moved.

* * * * *